US005449174A

United States Patent [19]

Criner

[11] Patent Number: 5,449,174

[45] Date of Patent: Sep. 12, 1995

[54] ROLLING DICE AGITATOR GAME

[76] Inventor: Delbert L. Criner, 431 Orchard St., Eureka, Calif. 95503

[21] Appl. No.: 361,745

[22] Filed: Dec. 22, 1994

[51] Int. Cl.[6] ..... A63F 9/04

[52] U.S. Cl. ..... 273/145 C; 273/145 D; 446/470; 446/448

[58] Field of Search ..... 273/145 D, 145 C, 145 CA, 273/145 R; 446/450, 453, 470, 448

[56] References Cited

FOREIGN PATENT DOCUMENTS 598743 5/1960 Canada ..... 446/448
625381 6/1949 United Kingdom ..... 273/145 D

OTHER PUBLICATIONS

Tarco Pull Toys advertisement, Playthings magazine Mar. 1961, p. 196.

*Primary Examiner*—Benjamin H. Layno

[57] ABSTRACT

An agitator for generating a random number for use in an associated game. The inventive device includes a vehicle body supported by a plurality of wheels. A transparent dome is coupled to the vehicle body and encloses a pair of dice therewithin. A spring plate positioned beneath the dice oscillates in response to a movement of the vehicle wheels to agitate the dice to generate a random number.

4 Claims, 4 Drawing Sheets

ROLLING DICE AGITATOR GAME

BACKGROUND OF THE INVENTION

1. Field of the Invention

The present invention relates to random number selecting devices and more particularly pertains to a rolling dice agitator game for generating a random number for use within an associated game.

2. Description of the Prior Art

The use of random number selecting devices is known in the prior art. More specifically, random number selecting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art random number selecting devices include U.S. Pat. No. 5,236,193; U.S. Pat. No. 5,149,101; U.S. Pat. No. 5,092,605; U.S. Pat. No. 4,266,769; and U.S. Pat. No. 3,463,496.

While these devices fulfill their respective, particular objectives and requirements, the aforementioned patents do not disclose a rolling dice agitator game for generating a random number for use in an associated game which includes a vehicle body supported by a plurality of wheels, a transparent dome coupled to the vehicle body for enclosing a pair of dice, and a spring plate positioned beneath the dice which oscillates in response to a movement of the vehicle wheels to agitate the dice.

In these respects, the rolling dice agitator game according to the present invention substantially departs from the conventional concepts and designs of the prior art, and in so doing provides an apparatus primarily developed for the purpose of generating a random number for use in an associated game.

SUMMARY OF THE INVENTION

In view of the foregoing disadvantages inherent in the known types of random number selecting devices now present in the prior art, the present invention provides a new rolling dice agitator game construction wherein the same can be utilized for generating a random number for use in an associated game. As such, the general purpose of the present invention, which will be described subsequently in greater detail, is to provide a new rolling dice agitator game apparatus and method which has many of the advantages of the random number selecting devices mentioned heretofore and many novel features that result in a rolling dice agitator game which is not anticipated, rendered obvious, suggested, or even implied by any of the prior art random number selecting devices, either alone or in any combination thereof.

To attain this, the present invention generally comprises an agitator for generating a random number for use in an associated game. The inventive device includes a vehicle body supported by a plurality of wheels. A transparent dome is coupled to the vehicle body and encloses a pair of dice therewithin. A spring plate positioned beneath the dice oscillates in response to a movement of the vehicle wheels to agitate the dice to generate a random number.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rolling dice agitator game apparatus and method which has many of the advantages of the random number selecting devices mentioned heretofore and many novel features that result in a rolling dice agitator game which is not anticipated, rendered obvious, suggested, or even implied by any of the prior art random number selecting devices, either alone or in any combination thereof.

It is another object of the present invention to provide a new rolling dice agitator game which may be easily and efficiently manufactured and marketed.

It is a further object of the present invention to provide a new rolling dice agitator game which is of a durable and reliable construction.

An even further object of the present invention is to provide a new rolling dice agitator game which is susceptible of a low cost of manufacture with regard to both materials and labor, and which accordingly is then susceptible of low prices of sale to the consuming public, thereby making such rolling dice agitator games economically available to the buying public.

Still yet another object of the present invention is to provide a new rolling dice agitator game which provides in the apparatuses and methods of the prior art some of the advantages thereof, while simultaneously overcoming some of the disadvantages normally associated therewith.

Still another object of the present invention is to provide a new rolling dice agitator game for generating a random number for use in an associated board game.

Yet another object of the present invention is to provide a new rolling dice agitator game which includes a vehicle body supported by a plurality of wheels, a transparent dome coupled to the vehicle body for enclosing a pair of dice, and a spring plate positioned beneath the dice which oscillates in response to a movement of the vehicle wheels to agitate the dice.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
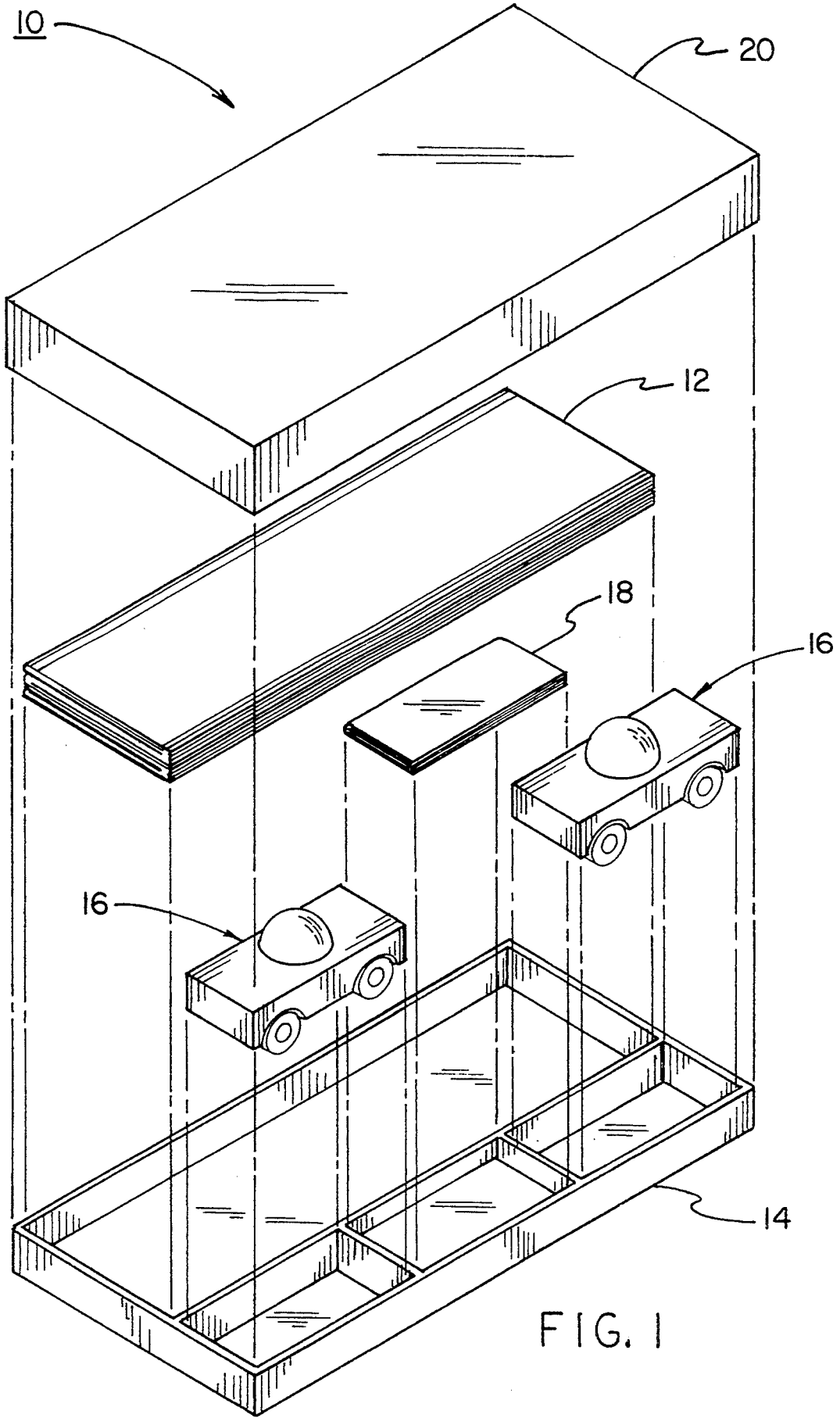
FIG. 1 is an isometric illustration of a rolling dice agitator game according to the present invention.

With reference now to the drawings, and in particular to FIGS. 1–6 thereof, a new rolling dice agitator game embodying the principles and concepts of the present invention and generally designated by the reference numeral 10 will be described.

Figure 6:
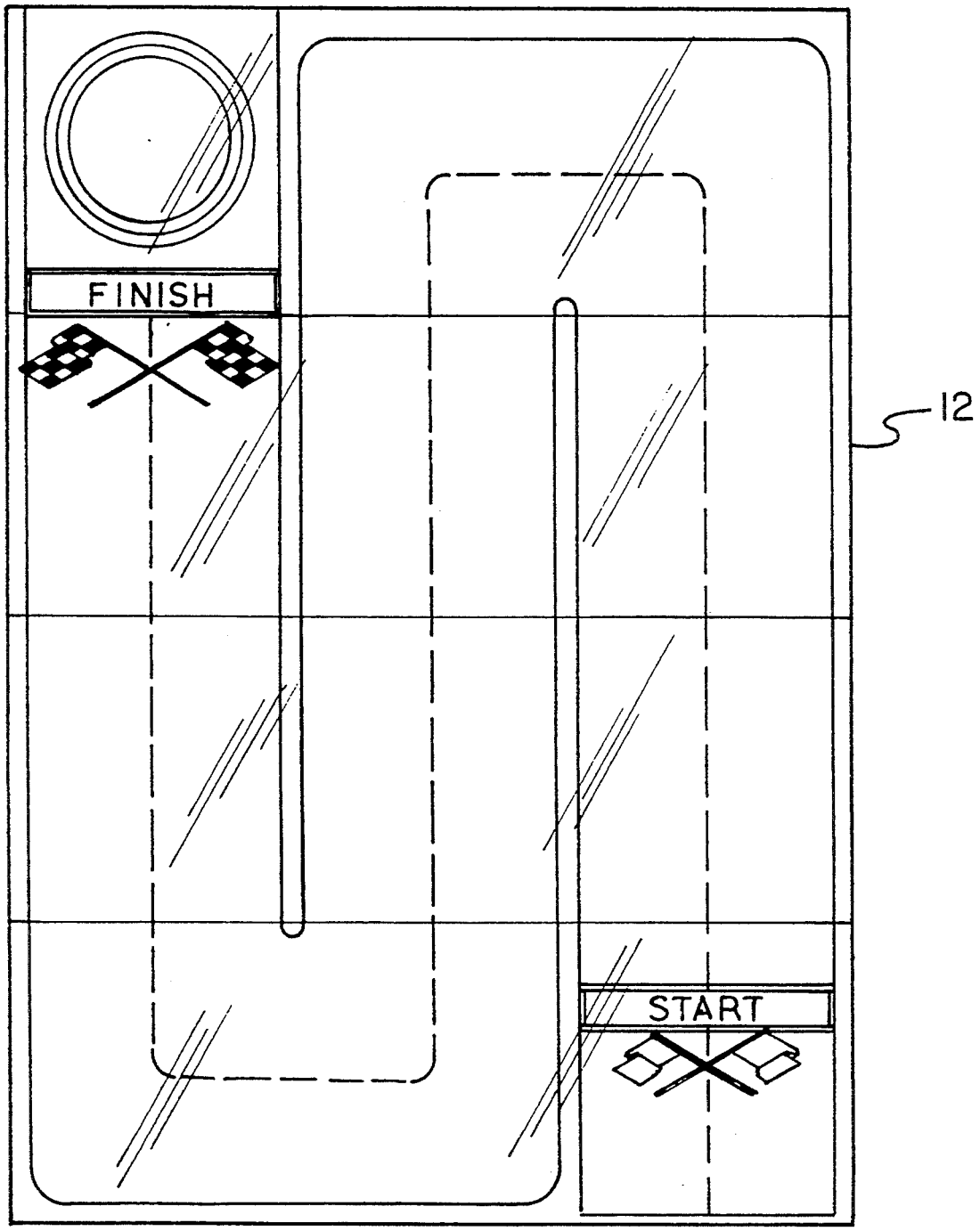
FIG. 6 is a plan view of a game board comprising a portion of the present invention.

More specifically, it will be noted that the rolling dice agitator game 10 comprises a game board 12, as shown in FIG. 6, which can be folded into the orientation illustrated in FIG. 1 for storage within a tray 14. The rolling dice agitator game 10 includes random number means 16 for generating a random number for use within an associated game method which will be subsequently described in more detail. The random number means 16 are received within the tray 14 for storage. A plurality of cards 18 can also be stored within the tray 14, with a cover 20 selectively enclosing the components 12–18 as desired.

Figure 4:
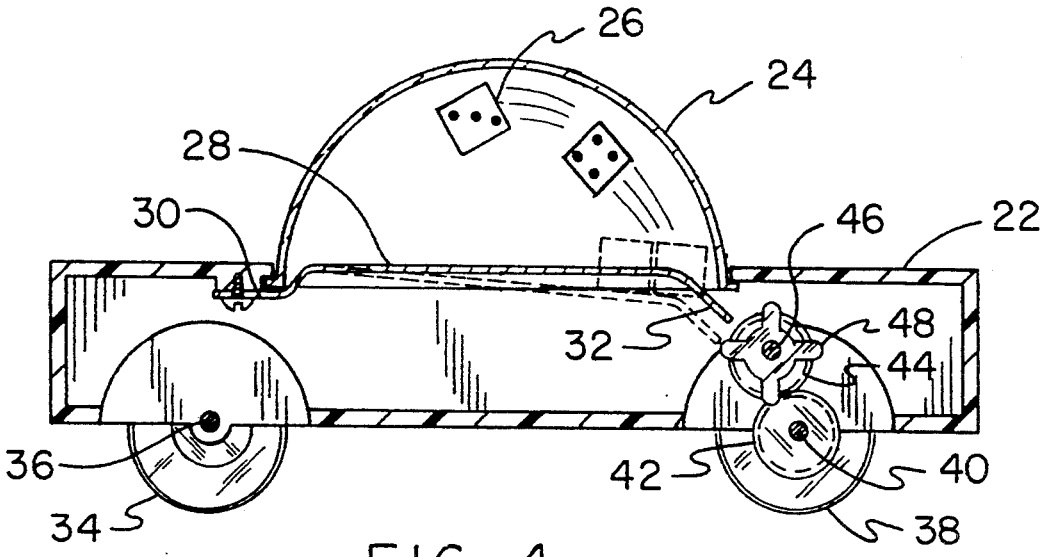
FIG. 4 is a cross-sectional view taken along line 4—4 of FIG. 2.
Figure 5:
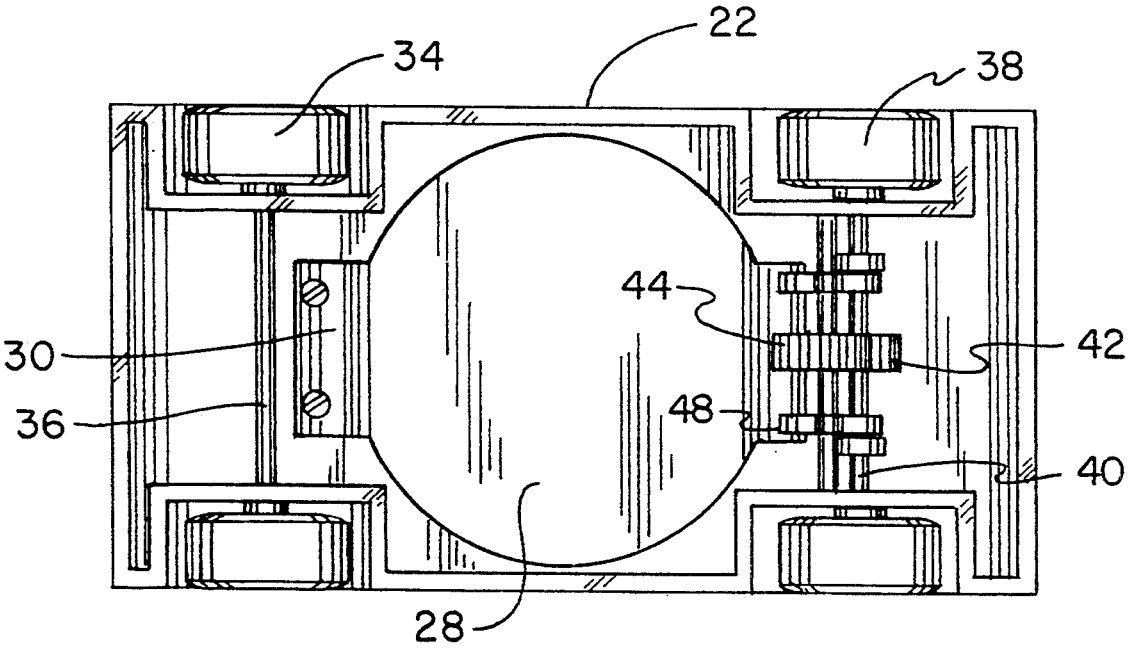
FIG. 5 is a bottom plan view of the random number means.

As best illustrated in FIGS. 2 through 5, it can be shown that the random number means 16 according to the present invention 10 preferably comprises a vehicle body 22 shaped so as to resemble an exterior of an automobile or the like vehicle and having a transparent dome 24 coupled to a top surface thereof. At least one die 26 is positioned within the transparent dome 24, whereby an individual can view the die through the dome. Preferably, a pair of dice 26 are positioned within the dome 24. As shown in FIG. 4, the dice 26 are supported within the dome 24 upon a spring platform 28. The spring platform includes a laterally projecting mounting tab 30 which is mounted to a portion of the vehicle body 22 such that the spring platform 28 extends across a circular aperture extending through the upper surface of the vehicle body about which the transparent dome 24 is mounted. The spring platform 28 further includes a depending tab 32 projecting therefrom and oriented in a diametrically opposed relationship relative to the mounting tab 30. The depending tab 32 can be engaged to effect deformation of the spring platform 28, whereby a releasing of the depending tab 32 will result in a resilient biasing of the spring platform 28 towards the transparent dome 24 to agitate the dice 26 contained therewithin.

Figure 2:
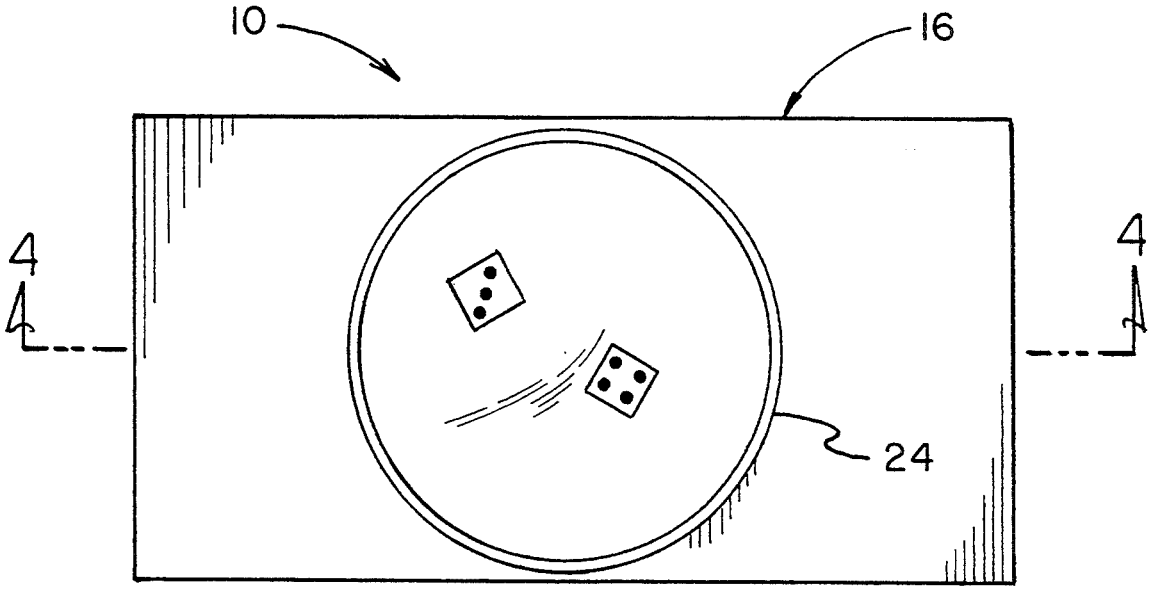
FIG. 2 is a top plan view of a random number means according to the present invention.
Figure 3:
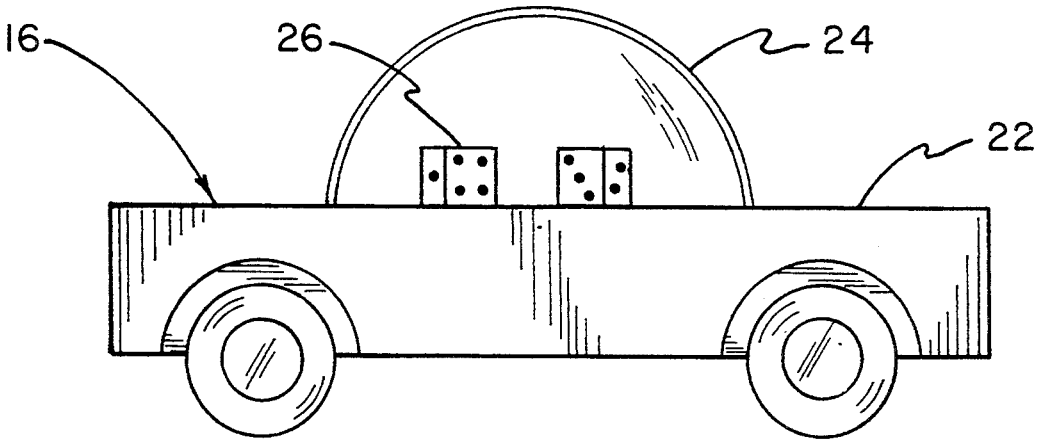
FIG. 3 is a side elevation view of the random number means.

To effect movement of the spring platform 28 during agitation of the dice 26, the vehicle body 22 is supported upon a plurality of wheels. The wheels of the random number means 16 include a pair of rear wheels 34 rotatably mounted to the vehicle body 22 by a rear axle 36 extending between the rear wheels and rotatably mounted to the vehicle body. Similarly, a pair of front wheels 38 are mounted to the vehicle body 22 by a front axle 40 extending between the front wheels and rotatably coupled to a portion of the vehicle body. By this structure, the vehicle body 22 can translate across a support surface upon the wheels 34 and 38. A driving gear 42 is mounted to the front axle 40 so as to rotate therewith and is positioned in mesh with a driven gear 44 rotatably mounted to the vehicle body 22 by a driven axle 46. A cog 48 is mounted to the driven axle 46 so as to rotate therewith in response to a rotation of the driving gear 42 engaging the driven gear 44. The cog 48 is positioned so as to engage the depending tab 32 of the spring platform 28 such that a rotation of the front wheels 38 will effect a repeated oscillation of the spring platform 28 to agitate the dice 26 contained within the transparent dome 24. By this structure, a translation of the vehicle body 22 across a support surface resulting in rotation of the front wheels 38 will cause a repeated oscillation of the spring platform 28 to agitate the dice 26 beneath the transparent dome 24. Upon a termination of motion of the vehicle body 22, the dice 26 will come to rest within the transparent dome 24 in a particular orientation corresponding to a value of the dice added together to generate a random number, as shown in FIG. 2.

In use, the random number means 16 according to the present invention 10 can be utilized in a game method wherein an agitation of the dice 26 is effected as described above. Preferably, a sum of the values shown on each of the die 26 must equal seven or eleven for a player to advance an equal number of spaces along the game board 12. A first player to cross the finish line on the game board 12 is declared a winner of the game method.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rolling dice agitator comprising:

a random number means for generating a random number, the random number means comprising a vehicle body having an aperture directed therethrough with a transparent dome coupled to a top surface thereof and positioned over the aperture; a die positioned within the transparent dome; a spring platform mounted to the vehicle body and extending across an open end of the dome, the die resting on the spring plate; and means for effecting movement of the spring plate to agitate the die in response to a forward movement of the vehicle body over a support surface.

2. The rolling dice agitator of claim 1, wherein the spring platform includes a laterally projecting mounting tab mounted to a portion of the vehicle body such that the spring platform extends across the aperture thereof, the spring platform further including a depending tab projecting therefrom, whereby the depending tab can be engaged to effect deformation of the spring platform such that a releasing of the depending tab will result in a resilient biasing of the spring platform towards the transparent dome to agitate the die contained therewithin.

3. The rolling dice agitator of claim 2, wherein the means for effecting movement of the spring plate comprises a plurality of wheels rotatably mounted to the body, the wheels including a pair of front wheels mounted to the vehicle body by a front axle extending between the front wheels and rotatably coupled to a portion of the vehicle body; a cog rotatably mounted relative to the vehicle body and positioned in mechanical communication with the front axle, the cog being positioned so as to engage the depending tab of the spring platform such that a rotation of the front wheels will effect a repeated oscillation of the spring platform to agitate the die contained within the transparent dome during movement of the vehicle body over a support surface.

4. The rolling dice agitator of claim 3, wherein the means for effecting movement of the spring plate further comprises a driving gear mounted to the front axle so as to rotate therewith; a driven gear rotatably mounted to the vehicle body and positioned in mesh with the drive gear, the drive gear being in mesh with the cog to effect rotation thereof.

* * * * *